US005367723A

United States Patent [19]

Pleva et al.

[11] Patent Number: 5,367,723

[45] Date of Patent: Nov. 29, 1994

[54] VALVE FOR REGULATING WATER LEVEL IN A SWIMMING POOL

[75] Inventors: John Pleva; Mark G. Pleva, both of Woodward, Iowa

[73] Assignee: Pleva Plumbing & Heating, Inc., Woodward, Iowa

[21] Appl. No.: 22,975

[22] Filed: Feb. 25, 1993

[51] Int. Cl.[5] ..... E04H 4/12

[52] U.S. Cl. ..... 4/508; 4/507; 137/428

[58] Field of Search ..... 4/500; 137/428, 411, 137/430; 251/326, 329

[56] References Cited

U.S. PATENT DOCUMENTS

| | | | |
|---|---|---|---|
| 795,346 | 7/1905 | Ferguson | 137/411 |
| 1,522,082 | 1/1925 | Ruths | 137/411 |
| 1,586,476 | 5/1926 | Simpson | 137/428 |
| 1,799,849 | 4/1931 | Hardacker et al. | 137/411 |
| 1,800,378 | 4/1931 | Everson | 4/508 |
| 2,300,856 | 11/1942 | Anderson | 137/411 |
| 2,739,939 | 3/1956 | Leslie | 137/428 |
| 2,809,752 | 10/1957 | Leslie | 4/508 |
| 3,739,405 | 6/1973 | Schmidt | 4/508 |
| 4,185,333 | 1/1980 | Ortega | 4/508 |
| 4,607,399 | 8/1986 | Yovanofski | 4/508 |

*Primary Examiner*—Henry J. Recla
*Assistant Examiner*—Charles R. Eloshway
*Attorney, Agent, or Firm*—Zarley, McKee, Thomte, Voorhees, & Sease

[57] ABSTRACT

A valve apparatus is provided for regulating the water level in a swimming pool. The apparatus is mounted in a surge pit remote from the pool. The apparatus includes first and second valves movable between open and closed positions for controlling the introduction of water into the surge pit from the main drain line and from a fresh water supply line, respectively. The first and second valves are operatively interconnected and are moved between their open and closed positions by a float member in the surge pit. As the water level in the pool drops below an ideal level wherein a thin layer of water skims over the lip of the gutter system, less water is provided to the surge pit from the gutter drain line, such that the water level in the pit drops, and causing the float member to drop so as to open the first and second valves to allow more water into the surge pit from the main drain line of the pool and from the fresh water supply line. Conversely, as the water level in the pool rises above an ideal level, excess water from the gutter drain line is supplied to the pit, thereby raising the water level therein, and raising the float member so as to close the first and second valves, thereby decreasing the flow of water from the main drain line and from the fresh water supply line.

11 Claims, 2 Drawing Sheets

VALVE FOR REGULATING WATER LEVEL IN A SWIMMING POOL

BACKGROUND OF THE INVENTION

Swimming pools normally have a perimeter gutter system which helps to maintain the cleanliness of the pool water. The gutter system includes a drainage line which leads to a remote reservoir or surge pit, which is part of the pool filtration system.

Proper functioning of the gutter system depends upon a proper water level in the pool. Ideally, the water level in the pool is just high enough such that a thin layer of water continuously skims over the edge of the gutter so as to carry floating debris, such as leaves and bugs, into the gutter. If the water level is too low, the water will not flow into the gutter, and the debris will remain in the pool. If the water level is too high, the debris can float from the gutter back into the pool.

The pool also has a main drain, normally located in the deepest portion of the pool for delivering water to the remote surge pit. The amount of water blended in the pit from the gutter system and from the main drain is determined by the pool designer and/or governmental regulations. Typically, 60–80% of the water in the pit will come from the gutter system, and 20–40% of the water in the pit will come from the main drain of the pool.

The water level in the pool may drop due to evaporation, splashing, and the normal entry and exit of people from the pool. The water level in the pool may rise due to rain. In conventional pools, when the water level in the pool drops, the water level in the surge pit also drops. If the water level in the pit drops too much, the pump which pumps water from the pit to the filtration system may run dry, thereby damaging the pump. In the past, the water level in the pool was regulated by manual adjustment of a valve, which necessarily was a delayed reaction to changing water levels in the pool.

Therefore, the primary objective of the present invention is the provision of a swimming pool valve which will automatically and continuously regulate the level of water in the pool.

A further objective of the present invention is the provision of an apparatus and method for controlling the flow of water from water lines into a reservoir or pit in response to the water level in the pit.

A further objective of the present invention is the provision of a dual float valve which regulates the flow of water from two separate fluid lines in response to water level in a tank.

Still another objective of the present invention is the provision of an improved swimming pool valve which maintains a proper water level in the pool such that the gutter system functions properly.

Yet another objective of the present invention is the provision of a swimming pool valve which is economical to manufacture and durable in use.

These and other objectives will become apparent from the following description of the invention.

SUMMARY OF THE INVENTION

The valve of the present invention is intended for particular use in swimming pools, however uses in other environments, such as sewer reclamation plants, is also contemplated. The swimming pool is conventional, and includes a perimeter gutter system and a main drain in the deepest portion of the pool. The gutter and main drain both lead to a remote reservoir or surge pit on the upstream or inlet side of the pool filter system. A fresh water supply line also enters the surge pit.

The swimming pool valve of the present invention includes a first sliding gate valve operatively mounted on the terminal end of the main drain in the surge pit. A second valve member is provided on the fresh water supply line. The first and second valve members are operatively connected to a buoyant float which moves both of the valve members between their respective open and closed positions in response to the water level in the surge pit.

If the water level in the pool drops below an optimum level wherein a thin layer of water skims over the edge of the gutter, the supply of water from the gutter to the surge pit stops, thereby decreasing the water level in the pit. As the float member drops with the water level, the first and second valves are opened so as to increase the flow of water from the main drain and from the fresh water supply line into the pit. As the water rises upwardly in the surge tank to an equilibrium level, the float member rises to partially close the valve members. When the water level in the pool rises above an optimum level, such that excessive water is flowing into the gutters, the level of water in the surge pit rises from the excessive gutter water, thereby raising the float member and thus closing the first and second valve members.

DESCRIPTION OF PREFERRED EMBODIMENT

Figure 1:
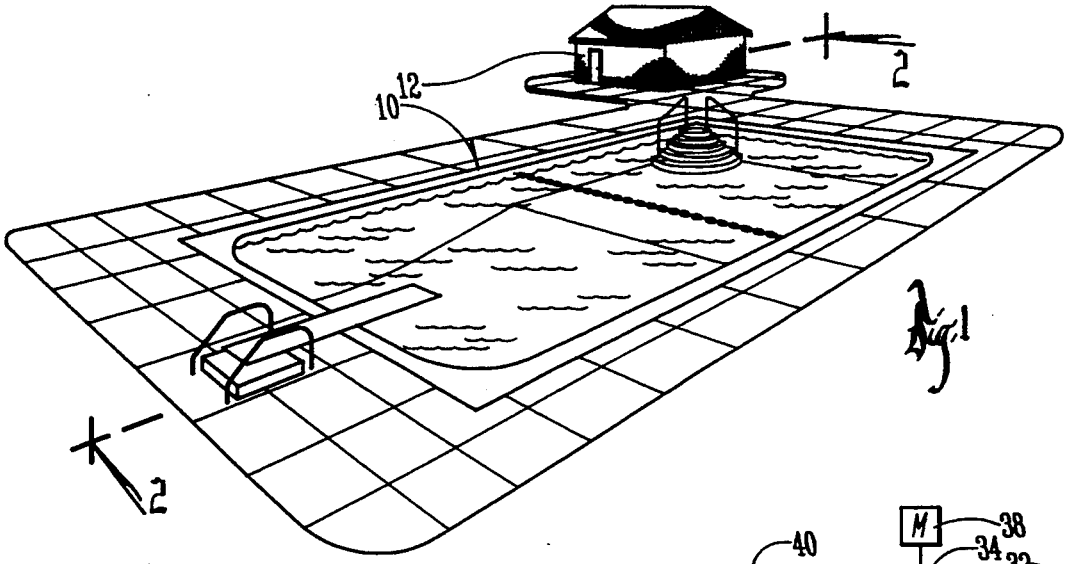
FIG. 1 is a perspective view of a swimming pool with a filter house adjacent the pool.
Figure 2:
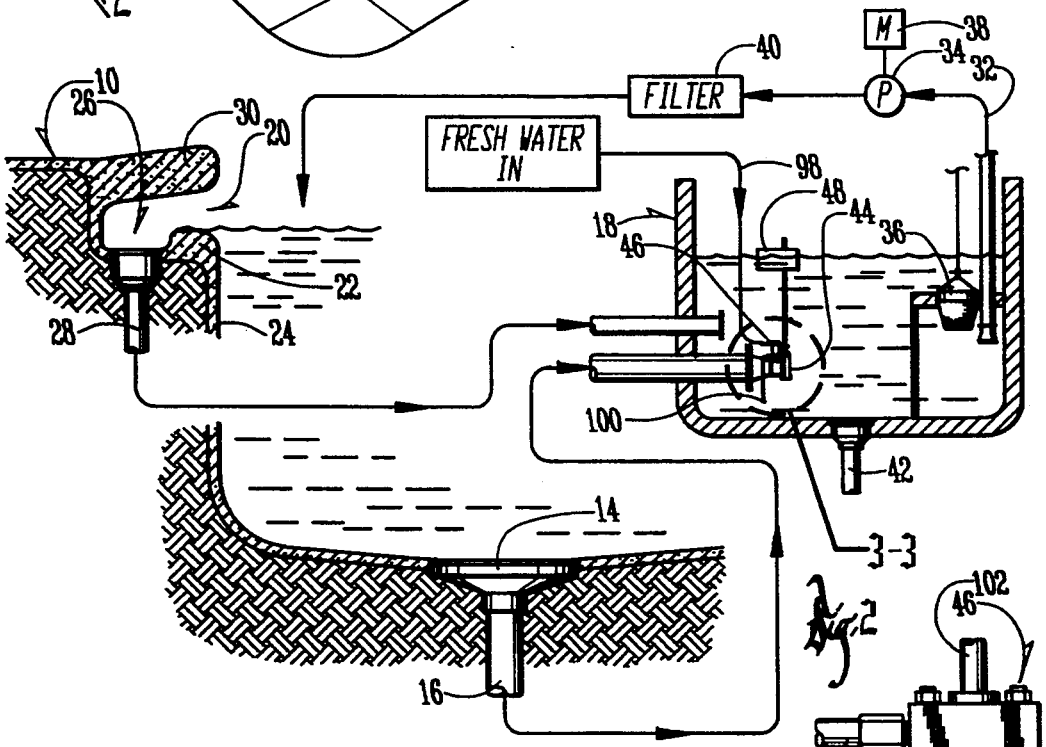
FIG. 2 is a schematic sectional view showing the gutter system, main drain, and surge pit of the swimming pool.
Figure 7:
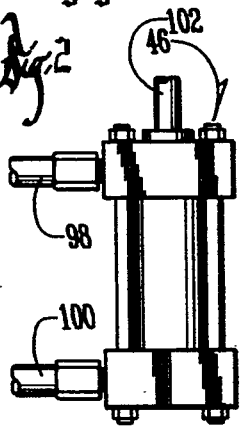
FIG. 7 is a side elevational view taken along lines 7–7 of FIG. 4.

With reference to FIGS. 1 and 2 of the drawings, a swimming pool is generally designated by the reference numeral 10. A filter house 12 contains the mechanical filtration and chlorination equipment for the pool. The pool 10 includes a main drain 14 in the deepest portion of the pool. The main drain 14 includes a drain line 16 leading to a reservoir or surge pit 18 in the filter house 12. The pool also includes a perimeter gutter system 20 extending around the pool. The gutter 20 includes a lip 22 adjacent the sidewall 24 of the pool and a recessed gutter cavity 26. A gutter drain line 28 leads from the gutter cavity 26 to the surge pit 18. The deck 30 of the pool extends over the gutter cavity 26, as best seen in FIG. 2.

The surge pit 18 is adapted to hold water draining from the main drain 14 and the gutter system 20. The surge pit includes a water supply line 32 leading to a pump 34 housed within the filter house 12. A filter basket or element 36 is adjacent the inlet of line 32 and removes debris from the water in the surge pit before the water is drawn into the line 32 by the pump 34. A motor 38 actuates the pump 34. The surge pit 18 and the pump 34 are on the supply side of the main pool filtration system 40, as illustrated in FIG. 2. The surge pit 18 also includes a drainage line 42 so the water can be drained from the pit.

The pool, the filter house and the surge pit, as described above, are conventional and are not a part of the present invention.

Figure 3:
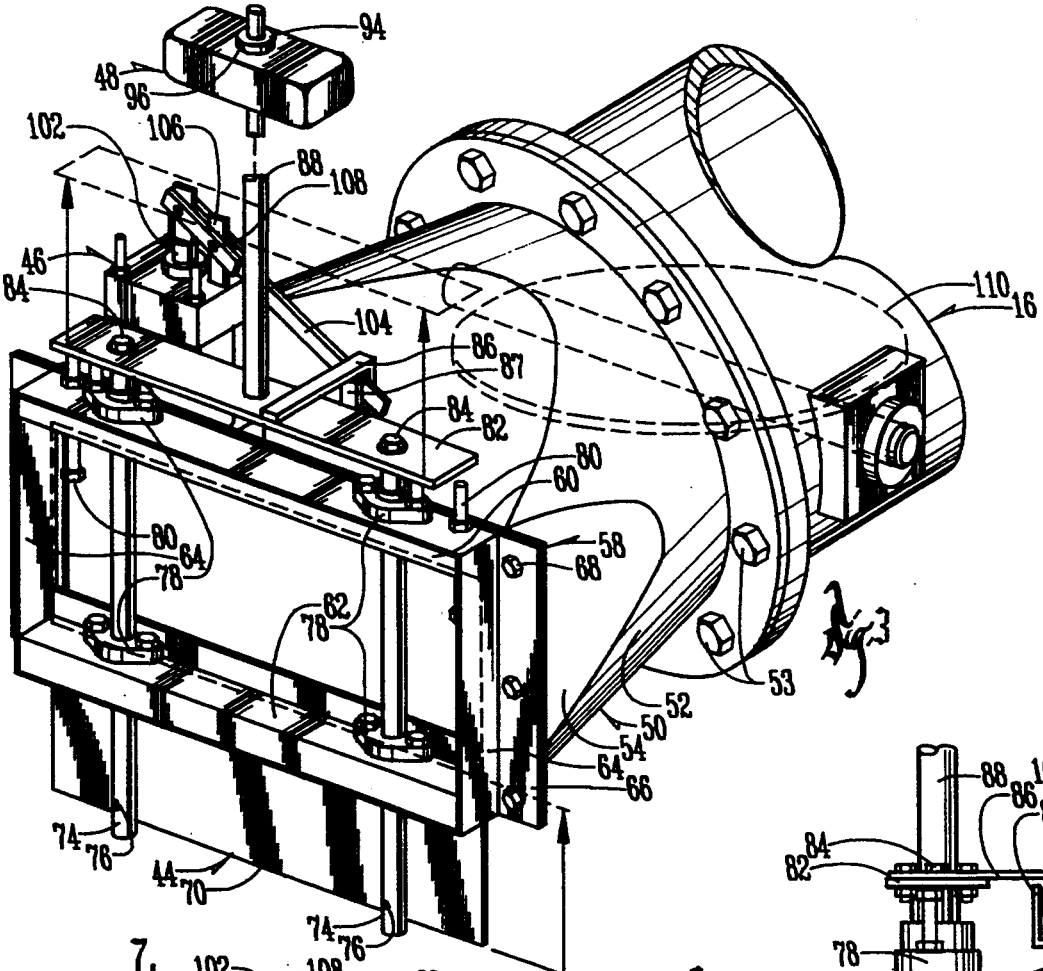
FIG. 3 is an enlarged perspective view of the valve apparatus of the present invention taken along lines 3—3 of FIG. 2.
Figure 4:
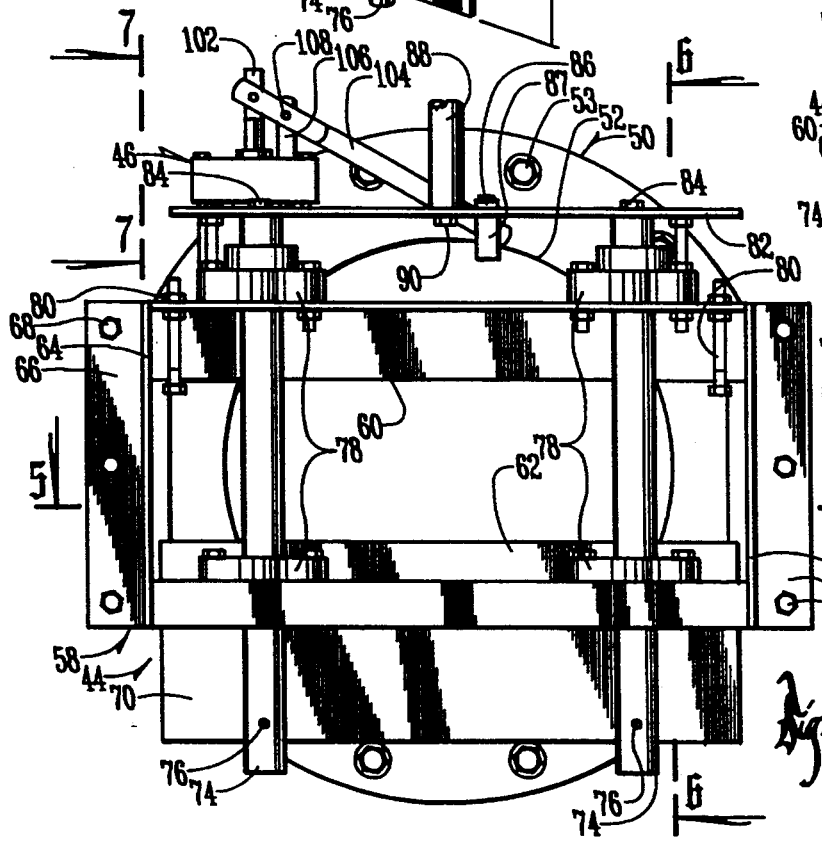
FIG. 4 is a front elevation view of the valve apparatus shown in FIG. 3.
Figure 6:
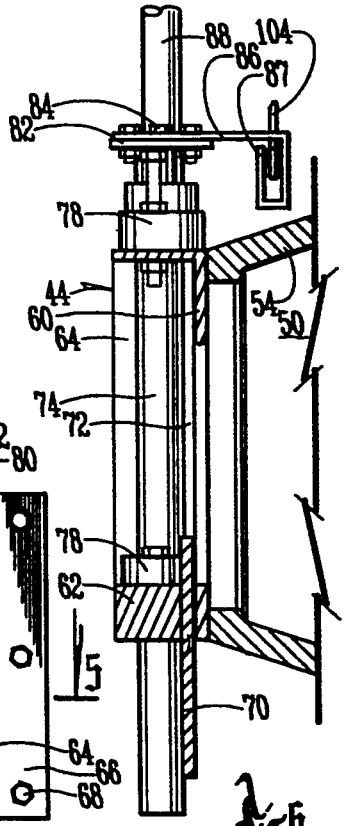
FIG. 6 is a sectional view taken along lines 6—6 of FIG. 4.

The present invention is directed toward a dual float valve apparatus for controlling or regulating the water level in the pool 10. More particularly, as best seen in FIG. 3, the apparatus of the present invention includes a first valve mechanism 44, a second valve mechanism 46, and a buoyant floatation member 48.

Figure 5:
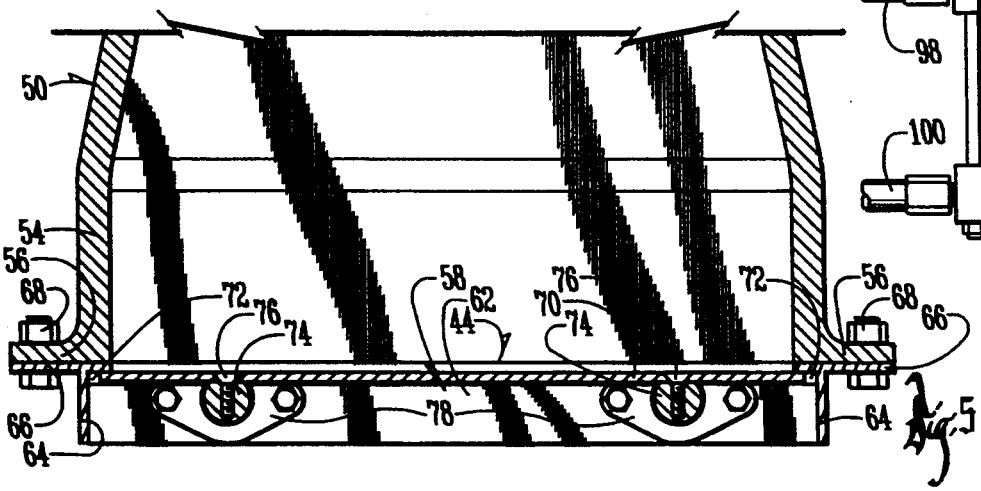
FIG. 5 is a sectional view taken along lines 5—5 of FIG. 4.

More particularly, a pipe section 50 having a round first end 52 is bolted by nut and bolt assemblies 53 to the end of the drain line 16 in the surge pit 18. The second end 54 of the pipe section 50 is rectangular and includes outwardly extending flanges 56 on opposite sides thereof, as seen in FIG. 5.

The first valve mechanism 44 includes a rectangular frame 58, including an upper member 60, a lower member 62, and opposite side members 64. Each side member 64 includes a flange 66 extending outwardly therefrom which is bolted to the flanges 56 of the pipe section 50 with nut and bolt assemblies 68.

A gate valve 70 is slidably positioned within a slot 72 formed within the frame 58 so as to be movable between a raised position closing the terminal end 54 of the pipe section 50 and a lowered position opening the end 54 of the pipe section 50. In effect, the gate valve opens and closes the drain line 16 of the main pool drain 14. The gate valve 70 is secured to a pair of guide rods 74 with screws 76. The guide rods 74 are slidably received within bushings 78 mounted upon the upper and lower members 60, 62 of the frame 58. The guide rods 74 are slidable upwardly and downwardly within the bushings 78. A pair of bolts 80 are mounted to the upper member 60 of the frame 58 and serve as stop members to limit the upward movement of the gate valve 70. The stop members 80 can be threadably raised or lowered so that the opening at the end of the pipe section 50 can be completely closed or partially closed when the gate valve 70 is raised to its uppermost position.

A horizontally disposed plate 82 is secured to the upper ends of the guide rods 74 with bolts 84. An arm 86 is secured to the plate 82 by welding or the like. The arm 86 includes U-shaped collar 87 at its outer end.

A vertically disposed float rod 88 is secured to the plate 82 at its lower end by bolt 90. The buoyant float member 48 is mounted adjacent the upper end of the float rod 88. The float member 48 is secured between a pair of collars 94 which are slidably received upon the float rod 88 and fixed in a desired position by set screws 96. Thus, the position of the float member 48 upon the float rod 88 can be selectively adjusted.

The second valve mechanism 46 is mounted upon the top of the pipe section 50 adjacent the second end 54 thereof. The second valve mechanism 46 is connected to a fresh water supply line 98 and has a fresh water outlet port 100. A valve (not shown) is mounted within the second valve member 46 so as to be movable between open and closed positions which control the flow of fresh water from the supply line 98 and through the outlet port 100 into the surge pit 18. A shaft 102 extends upwardly from the internal valve and is connected to an arm 104. The arm 104 extends into the collar 87 on the arm 86 attached to the plate 82. A post 106 extends upwardly from the second valve mechanism 46 and is secured to the arm 104 intermediate the ends thereof so as to define a pivot point 108. Thus, the arm 104 raises and lowers the shaft 102 so as to open and close the second valve mechanism 46.

A manually operated butterfly valve 110 or the like is provided in main drain line 16 so that flow of water into the pipe section can be stopped. Then the valve apparatus of the present invention can be easily installed or repaired.

In operation, the dual float valve apparatus of the present invention functions to regulate the level of water in the swimming pool 10. More particularly, the level of water in the pool 10 is ideally sufficient so that a thin layer of water skims over the lip 22 of the gutter so as to carry floating debris into the gutter cavity 26. The debris-carrying water flows through the gutter drain line 28 to the surge pit 18. Simultaneously, water drains from the pool through the main drain 14 and the drain line 16 into the surge pit 18. Thus, the surge pit is receiving a blend of water from the gutter system 20 and the main drain 14. Typically, the blend of water is in the range of 20%–40% from the main drain and 60%–80% from the gutter system. A small amount of water is also being supplied to the pit from the fresh water line 98. The blend is determined by the pool designer and/or government regulations, so as to achieve proper filtration and turnover of water in the pool.

The level of water in the pool is affected by different factors, such as evaporation and precipitation. Also, normal use of the pool by people causes water to be splashed and carried out of the pool, thereby tending to lower the pool water level. The valve apparatus of the present invention automatically reacts to these changing conditions so as to maintain the ideal water level in the pool.

When the water level in the pool begins to drop below the ideal level wherein a thin layer of water is skimming over the lip 22 of the gutter system 20, less water is introduced into the surge pit through the gutter drain line 28. When the water level in the surge pit drops, the float member 48 drops therewith, thereby moving the gate valve 70 downwardly to a more opened position through the interconnection of the float rod 88, the horizontal plate 82, the guide rods 74 and the gate valve 70. Simultaneously, the arm 86 on the plate 80 moves the lower end of the arm 104 downwardly therewith, and accordingly, pivots the upper end of the arm 104 upwardly so as to raise the shaft 102 and open the internal valve within the second valve mechanism 46. Thus, a lowered water level in the surge pit 18 causes the first and second valve members 44, 46 to be moved to an open position, thereby allowing additional water to enter the surge pit 18 through the main drain line 16 and through the fresh water supply line 98, respectively, thereby raising the water level in the surge pit 18. Thus, the pump 34 will not run dry.

Conversely, when the water level in the pool 10 begins to rise above the ideal level, excess water flows into the gutter drain line 28, thereby raising the water level in the surge pit 18. As the water level in the surge pit 18 increases, the float member 48 floats upwardly therewith, thereby moving the gate valve 70 upwardly to a closed position over the end of the pipe section 50 through the interconnection of the float rod 88, the horizontal plate 82, the guide rods 74 and the gate valve 70. Simultaneously, the arm 86 pulls the lower end of the arm 104 upwardly, thereby pivoting the upper end of the arm 104 downwardly so as to push the shaft 102 downwardly and thereby close the internal valve in the second valve mechanism 46. Thus, as the water level in the surge pit 18 rises, the first valve mechanism 44 and the second valve mechanism 46 are moved to a closed position stopping the supply of water from the main drain line 16 and the fresh water supply line 98 such that the quantity of water entering the surge pit 18 is decreased. As the pump 34 continuously operates, the water level in the pit 18 returns to normal.

Thus, the apparatus of the present invention provides an automatic regulation of the water level in the pool. In the prior art, the valves were manually opened and closed in response to visual observation of the water level in the pool or in the surge tank. However, such manual operation was reactive and often too late. If the water level in the surge tank dropped too far to a point below the end of the pump line 32, the pump 34 could run dry. Also, in the converse situation wherein the water level in the pool was excessively high, filtration of debris through the gutter system 20 would be hampered, since the debris would float in and out of the gutter cavity 26 due to the excessive depth of the water in the pool.

The present invention maintains a more constant water level in the surge pit 18, and thus a more constant water level in the pool 10. In normal operation, first and second valve mechanisms 44, 46 are partially open so that there is an inflow of water into the surge pit 18 from the main drain line 16, and from the fresh water supply line 98. Water is also coming into the pit from the gutter drain line 28 when the water level in the pool is ideal. As the float member 48 drops or rises with decreasing or increasing water levels in the surge pit 18, the first and second mechanisms 44, 46 are opened or closed to a greater extent so as to provide more or less water into the surge pit 18 from the main drain line 16 and the fresh water supply line 98, in accordance with the quantity of water being supplied to the surge pit from the gutter drain line 28. Thus, the dual float valve mechanism of the present invention regulates the water level in the pool The invention has been shown and described above in connection with the preferred embodiment, and it is understood that many modifications, substitutions and additions may be made which are within the intended broad scope of the invention. From the foregoing, it can be seen that the present invention accomplishes at least all of the stated objectives.

What is claimed is:

1. An apparatus for regulating water level in a swimming pool, the pool including a main drain for draining water from the pool into a remote water pit, a gutter extending around the perimeter of the pool and draining to the water pit, and a fresh water supply line for providing fresh water to the pit, the apparatus comprising:

a first valve operatively connected to the main drain and being movable between open and closed positions to control the flow of water from the main drain into the pit;

a second valve operatively connected to the fresh water supply line and being movable between open and closed positions to control the flow of water from the fresh water supply line into the pit; and a float operatively connected to the first and second valves to simultaneously move the valves in unison between the open positions and closed positions in response to changes in water level in the pit.

2. The apparatus of claim 1 wherein the first valve is operatively connected to the second valve.

3. The apparatus of claim 1 wherein the float includes a buoyant float member mounted on a vertically oriented float rod.

4. The apparatus of claim 3 wherein the first valve includes a gate valve secured to a guide rod, the guide rod adapted to slidably mounted on the main drain such that the gate valve is movable between the open and closed positions.

5. The apparatus of claim 4 wherein the float rod is operatively connected to the guide rod such that the float member raises and lowers the guide rod, thereby moving the gate valve between the closed and open positions, respectively, in response to changes in the water level in the pit.

6. The apparatus of claim 5 wherein the second valve includes a valve arm operatively connected to the guide rod so as to be movable between raised and lowered positions in coordination with movement of the guide rod, the raising and lowering of the valve arm controlling the closing and opening, respectively, of the second valve.

7. The apparatus of claim 3 wherein the float member is adjustably mounted on the float rod.

8. The apparatus of claim 1 further comprising an adjustable stop member for adjusting the extent of closure of the first valve.

9. The apparatus of claim 1 wherein the first valve means is a gate valve.

10. The apparatus of claim 1 wherein the main drain is round and has an end terminating in the pit, the apparatus further comprising a pipe section having a first round end for mating engagement with the end of the main drain and a second rectangular end to which the first valve is connected.

11. The apparatus of claim 1 wherein the float moves the first and second valves toward the open positions when the water level in the pit recedes and moves the first and second valves toward the closed positions when the water level in the pit rises.

* * * * *